US007828072B2

(12) United States Patent
Hashimoto et al.

(10) Patent No.: US 7,828,072 B2
(45) Date of Patent: Nov. 9, 2010

(54) IMPACT TOOL

(75) Inventors: Koichi Hashimoto, Hikone (JP); Hiroyuki Tsubakimoto, Hikone (JP); Hisashi Oda, Hikone (JP)

(73) Assignee: Panasonic Electric Works Co., Ltd., Kadoma-shi (JP)

( * ) Notice: Subject to any disclaimer, the term of this patent is extended or adjusted under 35 U.S.C. 154(b) by 0 days.

(21) Appl. No.: 12/493,918

(22) Filed: Jun. 29, 2009

(65) Prior Publication Data

US 2009/0266570 A1 Oct. 29, 2009

Related U.S. Application Data

(62) Division of application No. 11/254,806, filed on Oct. 21, 2005, now abandoned.

(30) Foreign Application Priority Data

Oct. 26, 2004 (JP) ..... 2004-311279

(51) Int. Cl.
*B25D 16/00* (2006.01)

(52) U.S. Cl. ..... 173/48; 173/47; 173/114; 173/117; 173/204; 173/120; 173/122; 227/131; 310/80; 310/103; 74/25

(58) Field of Classification Search ..... 173/47–48, 173/114, 117, 204, 120, 122; 227/131; 310/80, 310/103; 74/25
See application file for complete search history.

(56) References Cited

U.S. PATENT DOCUMENTS

| | | | | |
|---|---|---|---|---|
| 1,841,781 | A | 1/1932 | Bisschop et al. | |
| 2,067,886 | A | 1/1937 | Byford | |
| 2,943,216 | A | 6/1960 | Spodig | |
| 3,150,725 | A * | 9/1964 | Hornschuch et al. | 173/93 |
| 3,161,241 | A | 12/1964 | Allen et al. | |
| 4,011,477 | A * | 3/1977 | Scholin | 310/80 |
| 4,237,987 | A | 12/1980 | Sherman | |
| 4,431,062 | A | 2/1984 | Wanner et al. | |
| 4,567,951 | A | 2/1986 | Fehrle et al. | |
| 4,776,406 | A | 10/1988 | Wanner | |
| 5,024,127 | A | 6/1991 | Mueller et al. | |

(Continued)

FOREIGN PATENT DOCUMENTS

EP 1 584 422 A1 10/2005

(Continued)

*Primary Examiner*—Rinaldi I. Rada
*Assistant Examiner*—Michelle Lopez
(74) *Attorney, Agent, or Firm*—Oblon, Spivak, McClelland, Maier & Neustadt, L.L.P.

(57) ABSTRACT

An impact tool for simultaneously providing a rotational force and an impact force to an object has an output shaft rotated by a motor, hammer for intermittently providing an impact force to the output shaft, hammer holder for movably holding the hammer, and an impact force generator for generating the impact force from an output of the motor. An air chamber is formed between the hammer and the hammer holder such that a volume of the air chamber is variable in response to a position of the hammer relative to the hammer holder. In addition, the hammer receives a bias force generated in a direction toward the output shaft by a biasing device. This bias force effectively increases the impact force in cooperation with an air pressure caused by a volume change of the air chamber.

4 Claims, 7 Drawing Sheets

U.S. PATENT DOCUMENTS

| | | | | |
|---|---|---|---|---|
| 5,497,555 | A | 3/1996 | Averbukh | |
| 5,666,715 | A | 9/1997 | Zoiss et al. | |
| 6,520,269 | B2 | 2/2003 | Geiger et al. | |
| 6,695,070 | B1 | 2/2004 | Gokturk et al. | |
| 6,729,412 | B2 | 5/2004 | Shinohara | |
| 6,868,918 | B2 | 3/2005 | Shinohara | |
| 6,918,449 | B2 * | 7/2005 | Shinagawa et al. | 173/2 |
| 7,025,183 | B2 | 4/2006 | Steffen et al. | |
| 2002/0122707 | A1 | 9/2002 | Sakai et al. | |
| 2004/0074653 | A1 | 4/2004 | Hashimoto et al. | |

FOREIGN PATENT DOCUMENTS

| | | |
|---|---|---|
| GB | 942951 | 11/1963 |
| JP | 61-95807 | 5/1986 |
| JP | 8-276380 | 10/1996 |
| JP | 2595262 | 1/1997 |
| JP | 2002-254358 | 9/2002 |
| JP | 2004-82557 | 3/2004 |

* cited by examiner

IMPACT TOOL

CROSS-REFERENCE TO RELATED APPLICATIONS

This is a divisional of and claims the benefit of priority under 35 U.S.C. §120 from U.S. application Ser. No. 11/254,806, filed on Oct. 21, 2005, the entire contents of which are incorporated herein by reference, and which is based upon and claims the benefit of priority from prior Japanese Application No. 2004-311279, filed on Oct. 26, 2005.

BACKGROUND OF THE INVENTION

1. Field of the Invention

The present invention relates to an impact tool for simultaneously providing a rotational force and an impact force to an object.

2. Disclosure of the Prior Art

In the past, an impact tool for providing a rotational force of an output shaft to an object, and simultaneously giving an impact force to the object through the output shaft has been used to drill concrete, brick, stone and so on, which is also called as hammer drill.

For example, Japanese Patent Gazette No. 2595262 discloses a hammer drill comprising a motor, output shaft rotated by the motor and having a tool holder for detachably holding a tool, hammer for intermittently providing an impact force to the output shaft, and a piston for movably holding the hammer therein, and an impact force generator for converting an output of the motor into a reciprocating motion of the piston. An air chamber defined between the hammer and an inner bottom of the piston functions as an air spring to accelerate the hammer toward the output shaft. In addition, since this hammer drill has a gear shifter for automatically switching a reduction ratio between a slow-speed, high torque mode and a high-speed, low torque mode according to a load applied to the tool, the drilling operation can be efficiently achieved.

In addition, Japanese Patent Early Publication [kokai] No. 2004-082557 discloses a hammer drill comprising a motor, output shaft having a tool holder for detachably holding a tool and rotated by the motor through an intermediate shaft, hammer for intermittently providing an impact force to the output shaft, piston for movably holding the hammer therein, impact force generator for converting the rotation of the intermediate shaft into a reciprocating motion of the piston, and an impact force controller for changing a gear ratio between the motor and the intermediate shaft to control a magnitude of the impact force. According to this hammer drill, it is possible to provide the large impact force when using a drill bit with a large diameter as the tool, and provide the small impact force when using the drill bit with a small diameter. Thus, the drilling operation can be stably performed by use of an appropriate impact force according to the kind of tools used.

By the way, when the object is made of a hard material, or a large bore is formed in the object, the impact tool having the capability of generating a larger impact force is needed. To further increase the impulse force, it is proposed to use a heavy hammer, increase the torque by use of a high power motor, and/or extend the moving distance of the hammer in the impact tool. However, there is a problem that these proposals lead to an increase in weight and/or size of the impact tool.

SUMMARY OF THE INVENTION

Therefore, a primary concern of the present invention is to provide an impact tool having the capability of generating a large impact force, while minimizing the increase in weight and size of the impact tool.

That is, the impact tool of the present invention comprises a motor; an output shaft rotated by the motor; a hammer for intermittently providing an impact force to the output shaft; a hammer holder for movably holding the hammer; an impact force generator for converting an output of the motor into a reciprocating motion of the hammer to generate the impact force; and an air chamber formed between the hammer and the hammer holder such that a volume of the air chamber is variable in response to a position of the hammer relative to the hammer holder. The impact tool is characterized by further comprising a biasing unit configured to apply a bias force to the hammer in a direction toward the output shaft, thereby increasing the impact force in cooperation with an air pressure caused by a volume change of the air chamber.

According to the impact tool of the present invention, since the hammer speed is effectively increased in the direction toward the output shaft by the air pressure and the bias force, it is possible to generate a large impact force without using a high power motor and/or a heavy hammer. The biasing unit of the present invention provides the bias force in the direction of accelerating the hammer toward the output shaft independently from the output of the motor, i.e., without using the output of the motor.

It is preferred that the hammer is biased in the direction toward the output shaft against the hammer holder by the biasing unit to directly receive the bias force. In this case, it is possible to minimize the loss of the bias force, and efficiently increase the impact force. Alternatively, the biasing unit may be formed in the impact tool such that the hammer indirectly receives the bias force through said hammer holder. In this case, there is an advantage that the biasing unit can be designed at a high degree of freedom in the impact tool.

As a preferred embodiment of the biasing unit of the present invention, the biasing unit comprises a magnet, and a magnetic force of the magnet is provided as the bias force. Alternatively, the biasing unit comprises an elastic member such as coil spring, and an elastic force of the elastic member is provided as the bias force.

It is also preferred that the impact tool of the present invention further comprises a bias force adjusting unit configured to control a magnitude of the bias force provided by the biasing unit. In this case, it is possible to achieve an improvement in working efficiently and machining accuracy by appropriately selecting a magnitude of the impact force.

In addition, it is preferred that the impact tool further comprises an accelerating unit configured to increase a movement speed of the hammer in a direction away from the output shaft immediately after the impact force is provided to the output shaft. In this case, it is possible to realize a smooth reciprocating motion of the hammer, and consequently facilitate a further increase in the impact force.

As a preferred embodiment of the present invention, the bias unit comprises a fixed magnet on said hammer holder, a movable magnet supported in the housing of the impact tool and formed by a first region having one of N and S poles, and a second region having the other pole, and a drive unit configured to move the movable magnet such that when the hammer holder moves in the direction toward the output shaft, a magnetic repulsion force between the fixed magnet and the first region of the movable magnet, and when the hammer holder moves in a direction away from the output shaft, a magnetic attraction force occurs between the fixed magnet and the second region of the movable magnet. For example, the above-mentioned motor can be used as the drive unit.

These and additional features and advantages of the present invention will become more apparent from preferred embodiments explained below, referring to the attached drawings.

DETAIL DESCRIPTION OF PREFERRED EMBODIMENTS OF THE INVENTION

First Embodiment

Figure 1:
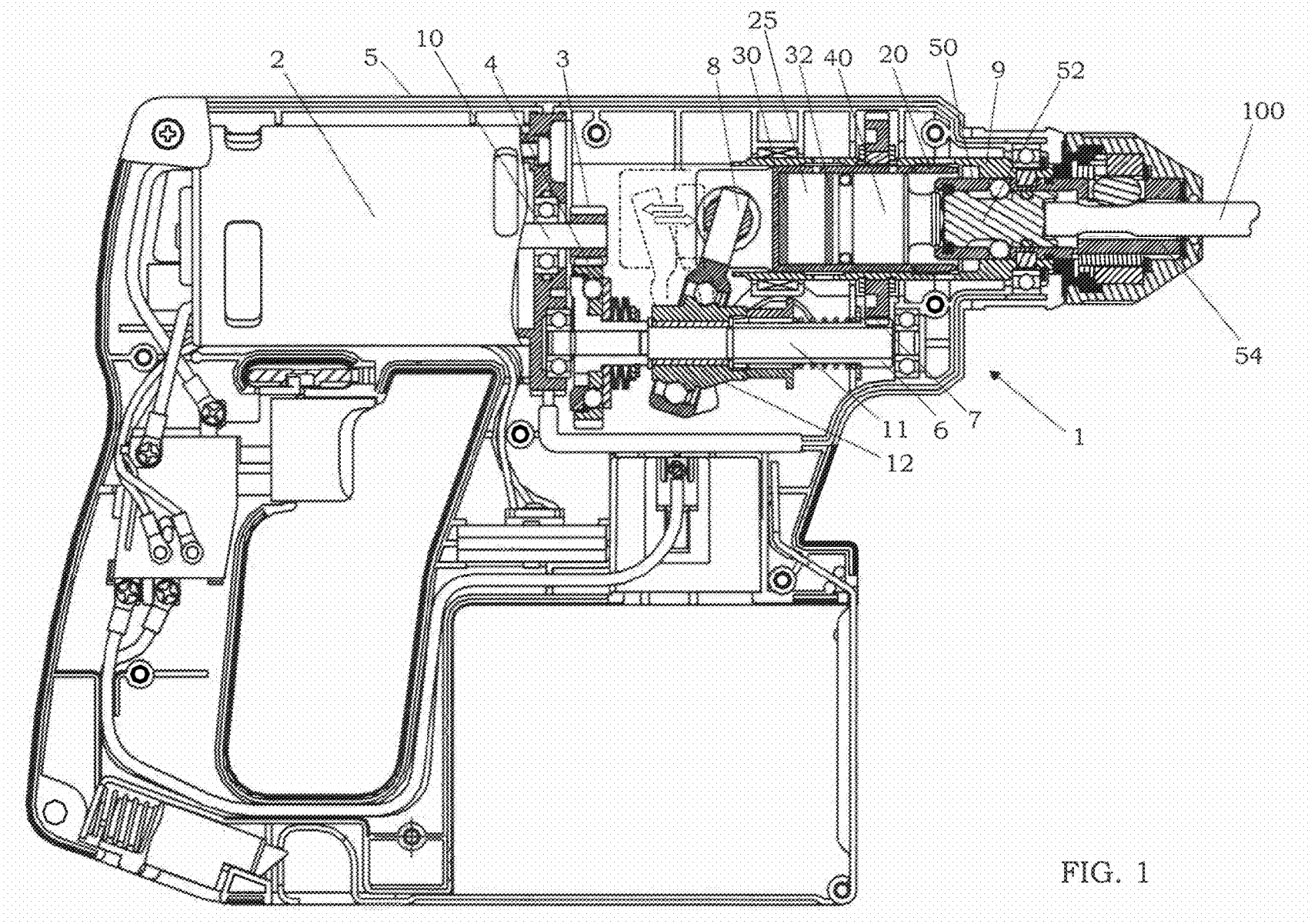
FIG. 1 is a cross-sectional view of an impact tool according to a first embodiment of the present invention.

An impact tool 1 of the present embodiment comprises a motor 2 incorporated in a housing 5, output shaft 50 rotated by the motor, hammer 40 for intermittently providing an impact force to the output shaft, a hammer holder 20 for movably holding the hammer, impact force generating mechanism (8, 12) for converting an output of the motor into a reciprocating motion of the hammer to generate the impact force, air chamber 25 formed between the hammer and the hammer holder such that a volume of the air chamber is variable in response to a position of the hammer relative to the hammer holder; and a biasing unit (30, 32) configured to apply a bias force to the hammer in a direction toward the output shaft. In the embodiments described below, a direction of moving the hammer 40 toward the output shaft 50 is called as "forward" direction, and therefore the "rearward" direction is the direction of moving the hammer 40 away from the output shaft 50.

An output of the motor 2 is transmitted to the output shaft 50 through the following power transmission mechanism. That is, the rotation of the motor shaft 10 is firstly transmitted to an intermediate shaft 11 through gears 3, 4. The intermediate shaft 11 is rotatably supported in the housing 5. The rotation of the intermediate shaft 11 is then transmitted to a spindle 9 through gears 6, 7. As a result, the output shaft 50 coupled with the spindle 9 is rotated by the motor 2. In FIG. 1, the numeral 52 designates an anvil disposed in a rear space in the output shaft 50 to receive the impact force of the hammer 40, and the numeral 54 designates a tool holder formed in a forward portion of the output shaft 50 to detachably hold a required tool 100 such as drill.

Figure 2A:
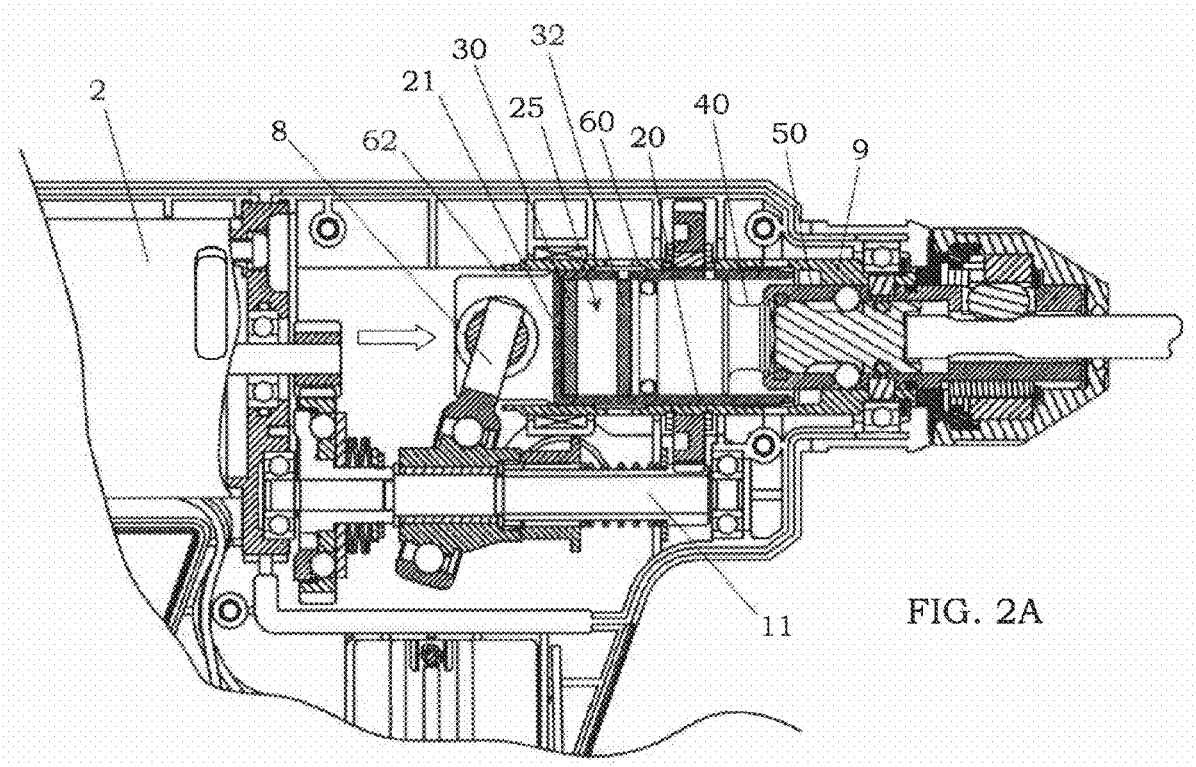
FIGS. 2A and 2B are partially cross-sectional views showing an operation of the impact tool.
Figure 2B:
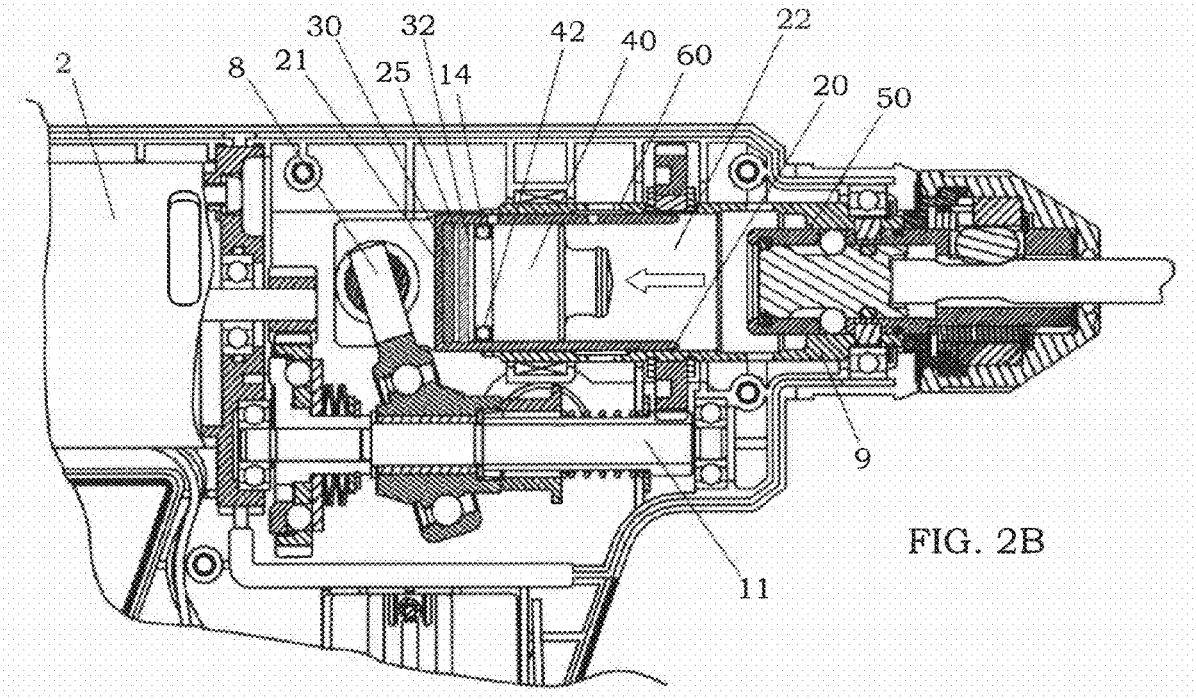

The impact force generating mechanism is formed with a bearing portion 12 formed on the intermediate shaft 11 in the circumferential direction, and a coupling member 8 movably supported at its one end by the bearing portion and connected at the other end with a rear end portion of the hammer holder 20. The rotation of the intermediate shaft 11 is converted into a swing motion of the coupling member 8 by the bearing portion 12, so that the hammer holder 20 coupled with the coupling member 8 is moved in a reciprocating manner (i.e., reciprocating piston motion) between a first position where the hammer holder 20 is located at the closest to the output shaft 50, as shown in FIG. 2A and a second position where the hammer holder 20 is located at the farthest from the output shaft 50, as shown in FIG. 2B. An axis of the swing motion of the coupling member 8 intersects with the axis of the intermediate shaft 11. A rotational movement of the coupling member 8 around the axis of the intermediate shaft 11 is restricted.

The hammer holder 20 is configured in a tubular structure with an inner bottom 21 at a side of the rear end portion connected with the coupling member 8 and a forward opening 22, through which the hammer 40 is inserted in the hammer holder. The hammer holder 20 is incorporated in a spindle case 60 to be movable in the forward and rearward directions through a rear opening 62 of the spindle case 60. The rotational motion of the spindle case 60 is not restricted by the hammer holder 20. The output shaft 50 is incorporated in a forward end portion of the spindle case 60. The hammer 40 is slidably held in the hammer holder 20 in the forward and rearward directions, and has a circular groove 42 formed around its bottom. An O-ring 14 is fitted in the circular groove 42, so that a space surrounded by a bottom surface of the hammer 40 and the inner surfaces of the hammer holder 20 is separated from the outside in an airtight manner. This space presents the air chamber 25 described above, and the inner volume thereof is variable in response to the forward and rearward movement of the hammer 40 in the hammer holder 20.

In the impact tool 1 with the above components, when the intermediate shaft 11 is rotated by the motor 2, the rotational motion of the spindle 9 is obtained, and simultaneously the reciprocating motion of the hammer holder 20 in the forward and rearward direction is obtained through the swing motion of the coupling member 8. At this time, due to a pressure difference between the interior of the air chamber 25 and the outside, and sliding resistance between the O-ring 14 and the hammer holder 20, the motion of the hammer 40 is not in a complete synchronization with the motion of the hammer holder 20. That is, the motion of the hammer 40 lags the motion of the hammer holder 20 by a slight time interval. As a result of this delay, the air chamber 25 is compressed by the rearward movement of the hammer 40 to increase the inner pressure of the air chamber. The increase in the internal pressure of the air chamber causes a compression reaction force for pushing back the hammer 40. Since the hammer 40 is biased in the forward direction by the compression reaction force when the hammer holder 20 is moved in the forward direction, an increased impact force can be provided to the tool 100 held by the output shaft 50 by the hammer 40. Thus, the impact force generating mechanism of this embodiment can convert the output of the motor 2 into the reciprocating motion of the hammer 40.

In the present embodiment, the biasing unit using magnets (30, 32) is formed in the impact tool 1 to further increase the impact force of the hammer 40. That is, disk-shaped magnets (30, 32) are respectively disposed on the inner bottom 21 of the hammer holder 20 and the bottom surface of the hammer 40 such that magnetic forces of those magnets are repulsive to each other in the air chamber 25. When the air chamber 25 is compressed by the rearward movement of the hammer 40 in the hammer holder 20, so that a distance between the inner bottom of the hammer holder 20 and the bottom surface of the hammer 40 becomes small, the magnetic repulsion force occurs to push the hammer 40 in the forward direction. Thus, since the hammer 40 is biased in the forward direction by both of the magnetic repulsion force and the compression reaction force described above, it is possible to provide a further increased impulse force to the output shaft 50 by the hammer 40.

Thus, since the internal space of the impact tool 1 used to generate the impact force is effectively used for the biasing unit, it is possible to achieve an increase of the impact force without upsizing the impact tool. In addition, when the magnets are used as the biasing unit, the impact tool with excellent cost performance can be provided.

Figure 3A:
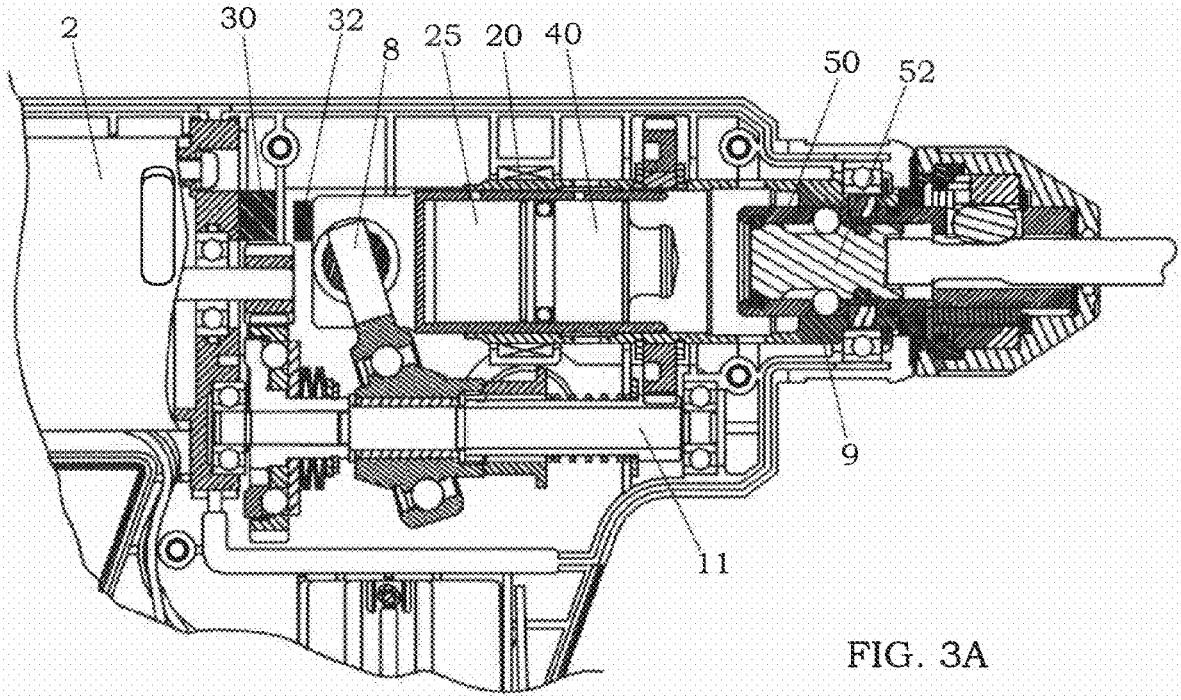
FIGS. 3A and 3B are partially cross-sectional views showing an operation of an impact tool according to a modification of the first embodiment.
Figure 3B:
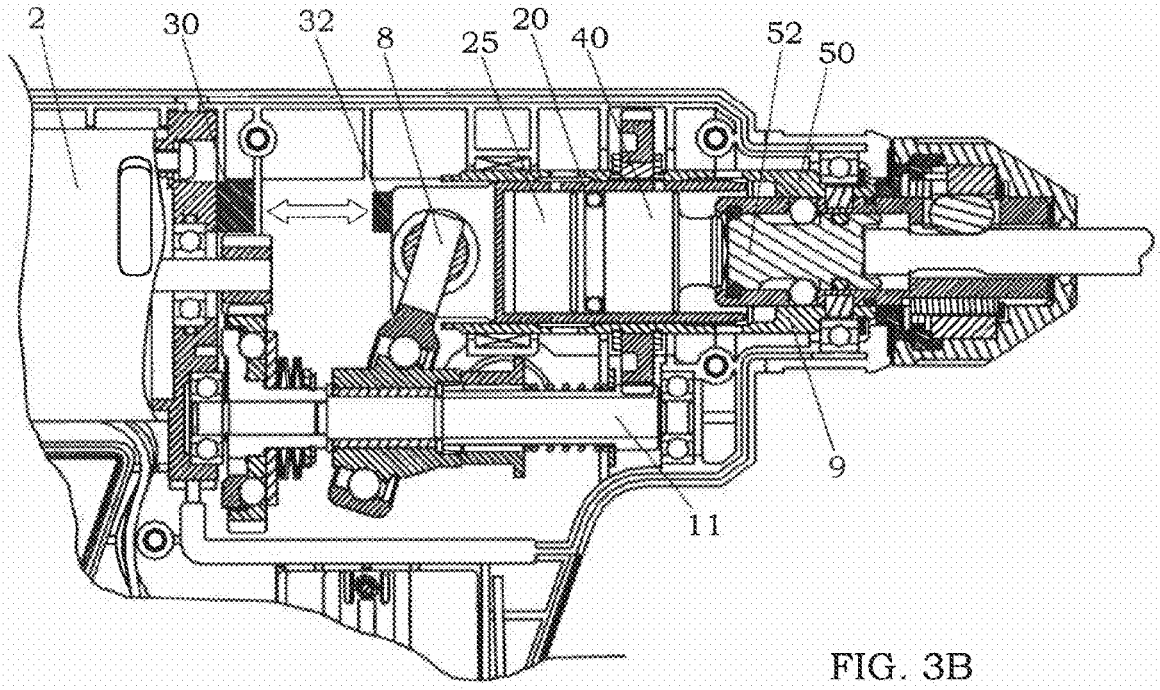

In this embodiment, the magnets (30, 32) may be disposed in the housing 5 other than the air chamber 25. For example, as a modification of this embodiment, as shown in FIGS. 3A and 3B, the magnet 32 is disposed on a rear end portion of the hammer holder 20, and the magnet 30 is fixed in the housing 5 of the impact tool to be in a face-to-face relation with the magnet 32. In this case, as the hammer holder 20 moves in the rearward direction, the distance between the magnets (30, 32) becomes smaller, so that a magnetic repulsion force works to move the hammer holder 20 in the forward direction. As a result, as in the case of the above embodiment, the hammer 40 is allowed to collide with the anvil 52 of the output shaft 50 at a higher speed. Thus, the magnetic force may be indirectly applied to the hammer 40 to increase the impact force. In this modification, there is a further advantage that the biasing unit, i.e., the arrangement of the magnets can be designed at a higher degree of freedom.

Figure 4:
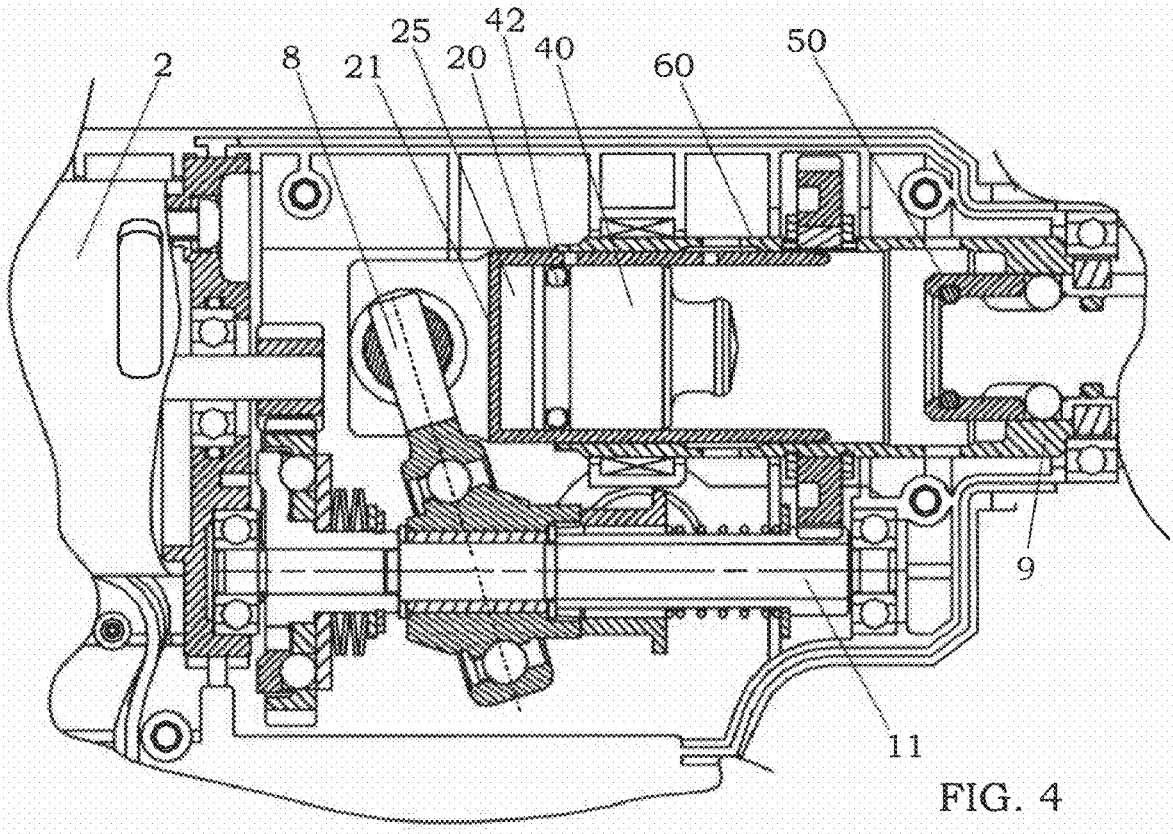
FIG. 4 is a partially cross-sectional view showing a relevant portion of an impact tool according to another modification of the first embodiment.

In addition, as another modification of this embodiment, it is preferred that at least a part of each of the hammer 40 and hammer holder 20 is made of a magnetic material. For example, as shown in FIG. 4, when a portion corresponding to the inner bottom 21 of the hammer holder 20 and a portion corresponding to the bottom surface of the hammer 40 are formed by use of the magnetic material such that a magnetic repulsion force is generated therebetween, it is possible to increase the impact force of the hammer, as in the case of the above embodiment. In this case, due to a reduction in the total number of parts, a further improvement in cost performance of the impact tool can be achieved.

Second Embodiment

An impact tool of this embodiment is substantially the same structure as the first embodiment except that an elastic member is used as a biasing device in place of the magnets. Therefore, the same components are designated by the same reference characters as those of the first embodiment, and duplicate explanation is omitted.

Figure 5:
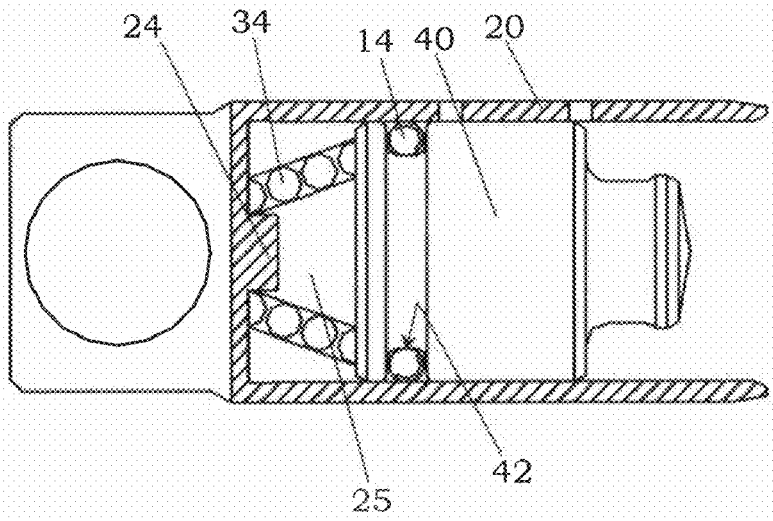
FIG. 5 is a cross-sectional view showing a biasing unit of an impact tool according to a second embodiment of the present invention.

That is, as shown in FIG. 5, the biasing unit of this embodiment is provided by an elastic member such as coil spring 34, which is disposed in the air chamber 25 defined between the hammer holder 20 and the hammer 40. In this case, when the hammer 40 moves in the rearward direction, the coil spring is compressed in the air chamber 25, so that a restoring force of the coil spring 34 works in the same forward direction as the compression reaction force caused by the volume change in the air chamber. Consequently, it is possible to obtain a further increased impact force, as in the case of the first embodiment.

In this embodiment, a coil spring having a conical-shape is used to effectively obtain the large repulsion force. In FIG. 5, the numeral 24 designates a columnar projection formed on the inner bottom of the hammer holder 20 to prevent a positional displacement of the coil spring 34 in the air chamber 25.

Third Embodiment

An impact tool of this embodiment is substantially the same structure as the modification of the first embodiment shown in FIGS. 3A and 3B except for further comprising a bias-force adjusting unit for changing a magnitude of the bias force provided by the biasing unit. Therefore, the same components are designated by the same reference characters as those of the first embodiment, and duplicate explanation is omitted.

Figure 6A:
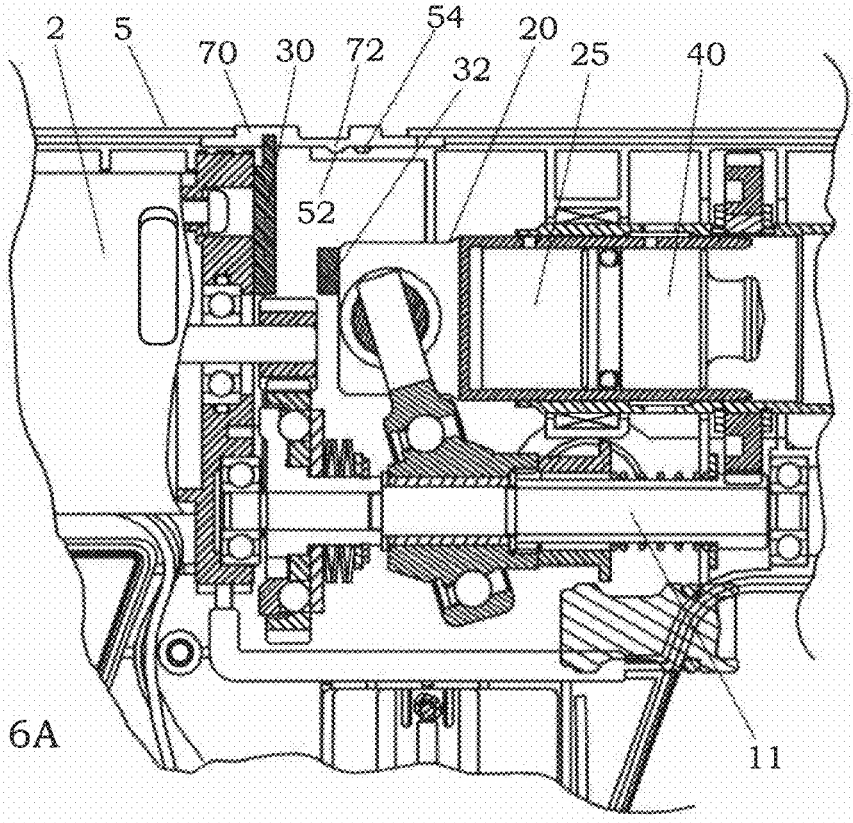
FIGS. 6A and 6B are partially cross-sectional views showing an operation of an impact tool according to a third embodiment of the present invention.
Figure 6B:
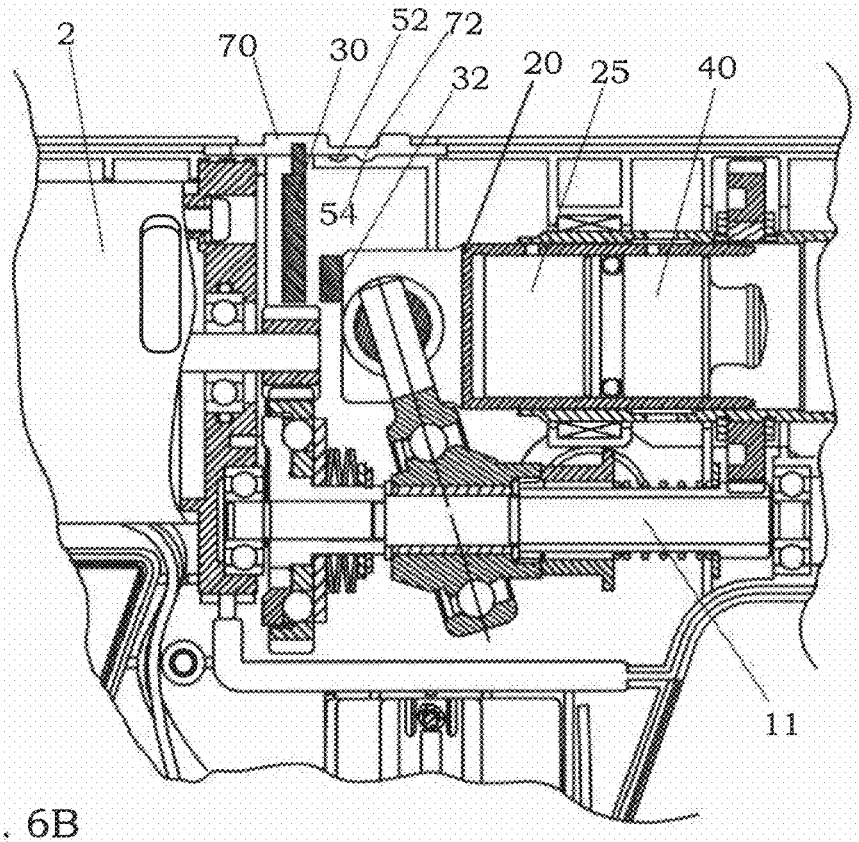

In the present embodiment, the biasing unit is formed with a magnet 32 disposed on a rear end portion of the hammer holder 20, and a magnet 30 disposed in the housing 5 of the impact tool 1 to be in a face-to-face relation with the magnet 32. The magnitude of the magnetic repulsion force developed between those magnets (30, 32) can be controller by operating the bias-force adjusting unit. That is, the magnet 30 is coupled to an adjust lever 70, which is slidably supported in the forward and rearward direction by the housing 5. In addition, the adjust lever 70 has a projection 72, which can be selectively engaged with one of a plurality of recesses formed in the housing 5. As shown in FIGS. 6A and 6B, the impact tool of this embodiment has a pair of recesses (52, 54). Therefore, by operating the adjust lever 70 to make an engagement between the projection 72 and a desired one of the recesses (52, 54), it is possible to control the distance between the magnets (30, 32), i.e., the magnitude of the magnetic repulsion force generated therebetween. Consequently an appropriate magnitude of the impact force can be provided to the output shaft 50 by the hammer 40.

Specifically, since the distance between the magnets (30, 32) is smaller in the case of making the engagement between the projection 72 and the recess 54, as shown in FIG. 6B, than the case of making the engagement between the projection 72 and the recess 52, as shown in FIG. 6A, a larger magnetic repulsion force can be developed in the case of FIG. 6B.

When an electromagnet is used as the biasing unit, it is possible to adjust the magnitude of the magnetic repulsion force by controlling an amount of electric current supplied to the electromagnet by use of a control circuit, and consequently obtain the appropriate magnitude of the impact force.

In this embodiment, since the magnitude of the impact force can be appropriately selected depending on purposes by use of a single impact tool, working efficiency and cost performance are improved, as compared with the case of using a plurality of impact tools.

Fourth Embodiment

An impact tool of this embodiment is substantially the same structure as the modification of the first embodiment shown in FIGS. 3A and 3B except that the biasing unit has the capability of increasing the impact force, and also smoothly moving the hammer holder in the rearward direction after the collision between the hammer and the anvil of the output shaft. Therefore, the same components are designated by the same reference characters as those of the first embodiment, and duplicate explanation is omitted.

Figure 7A:
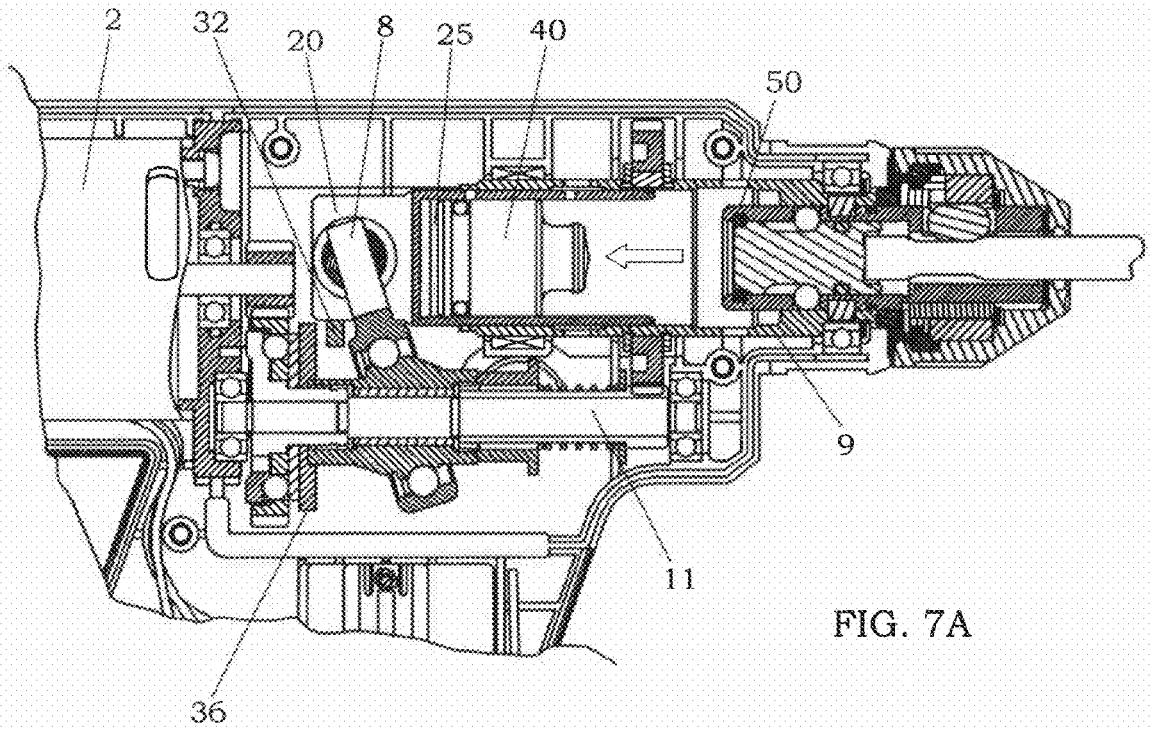
FIGS. 7A and 7B are partially cross-sectional views showing an operation of an impact tool according to a fourth embodiment of the present invention.
Figure 7B:
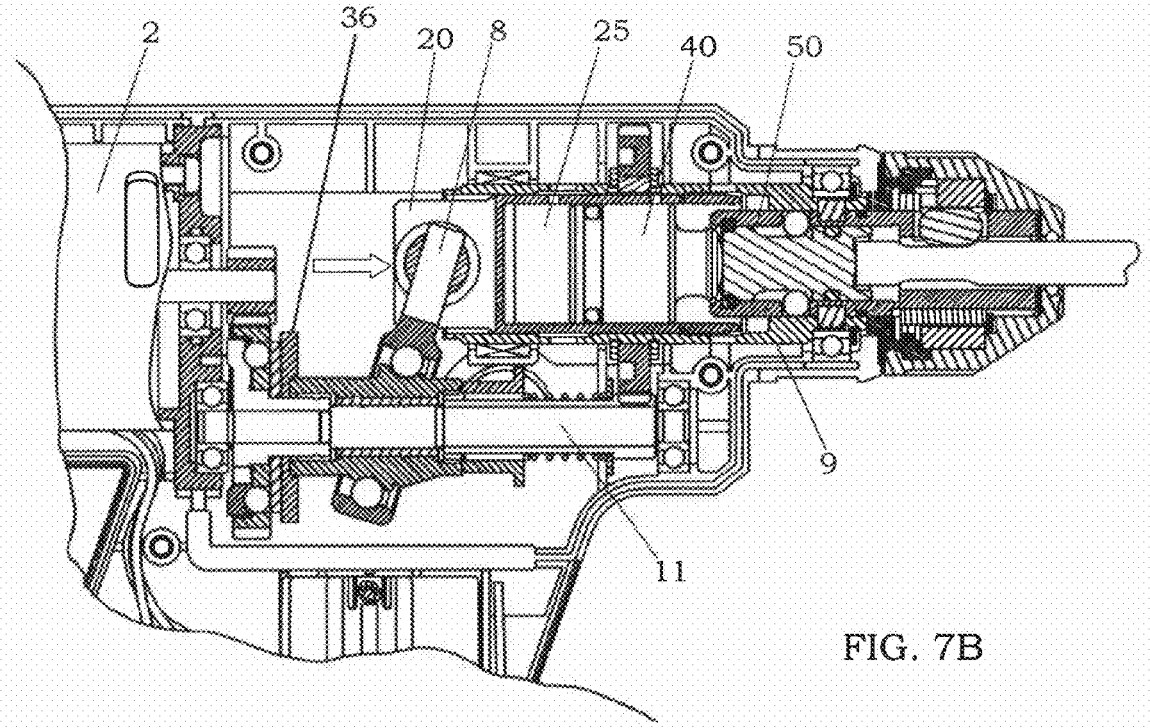
Figure 8A:
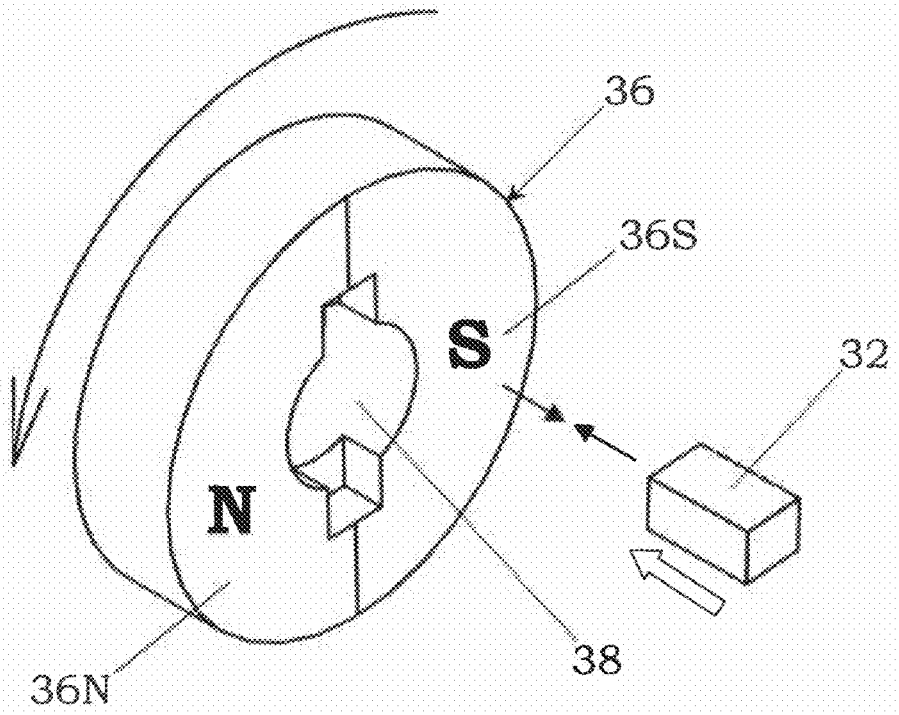
FIGS. 8A and 8B are schematic perspective views of a biasing unit of the impact tool of the fourth embodiment.

As shown in FIGS. 7A, 7B, 8A and 8B, the biasing unit of this embodiment is formed with a magnet 32 fixed to the rear end portion of the hammer holder 20, and a disk-shaped magnet member 36 composed of a first semicircle portion 36N of N pole portion and a second semicircle portion 36S of S pole. In FIG. 8A, the numeral 38 designates a through hole formed in the magnet member 36, into which the intermediate shaft 11 is inserted. Therefore, the magnet member 36 is rotated together with the intermediate shaft 11.

When the magnet member 36 is connected to the intermediate shaft 11, it is needed to satisfy the following conditions. For example, on the assumption that the magnet 32 fixed to the hammer holder 20 is N pole, when the hammer holder 20 moves toward the magnet member 36 (i.e., in the rearward direction), as shown in FIG. 8A, the second semicircle portion 36S of S-pole of the magnet member 36 faces the magnet 32 of N pole, so that a magnetic attraction force occurs therebetween to accelerate the rearward movement of the hammer holder 20. As a result, the air chamber 25 is more effectively compressed by the hammer 40, as shown in FIG. 7A. This means the occurrence of a larger compression reaction force. Thus, the face-to-face relation between the second semicircle portion 36S and the magnet 32 of N pole contributes to increase in the impact force.

Figure 8B:
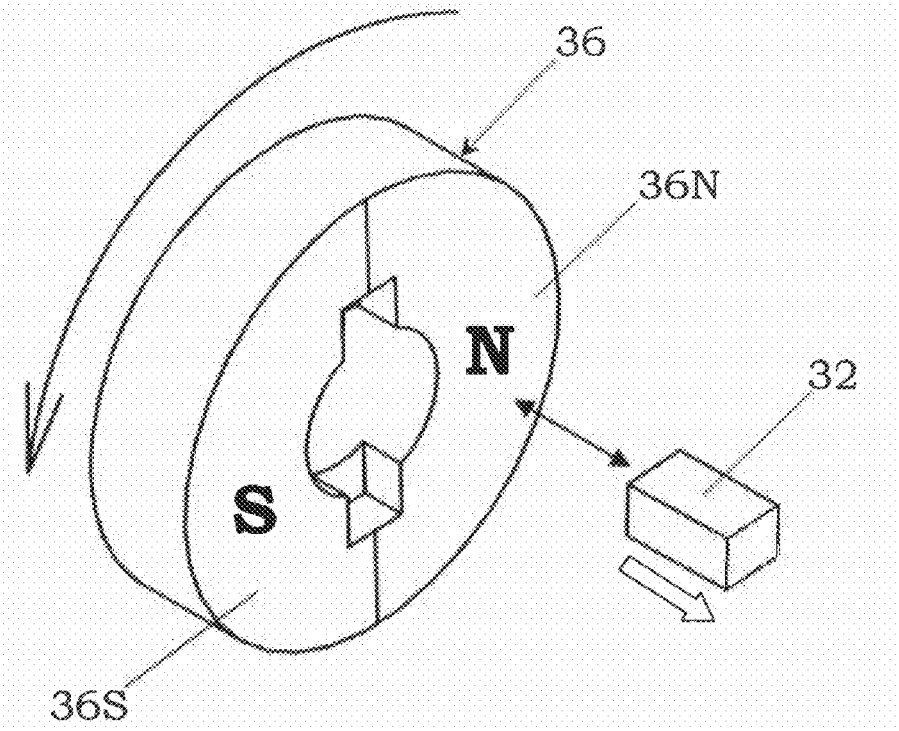

On the other hand, when the hammer holder 20 moves toward the output shaft 50 (i.e., in the forward direction), as shown in FIG. 8B, the first semicircle portion 36N of N-pole of the magnet member 36 faces the magnet 32 of N pole, so that a magnetic repulsion force occurs therebetween to accelerate the hammer holder 20 in the forward direction, as shown in FIG. 7B. Thus, the face-to-face relation between the first semicircle portion 36N and the magnet 32 of N pole contributes to increase in the impact force.

Therefore, by using the magnet member 36 having the N-pole portion and the S-pole portion as the biasing unit, and moving the magnet member 36 such that when the hammer holder 20 moves in the rearward direction, the magnetic attraction force occurs between the magnet member 36 and the magnet 32, and when the hammer holder 20 moves in the forward direction, the magnetic repulsion force occurs therebetween, it is possible to facilitate a smooth reciprocating motion of the hammer holder 20, and more effectively increase the impact force of the hammer 40.

The above embodiments described above are intended for illustrative purposes, and are not intended to limit the scope of the present invention. Therefore, any variation and modification for achieving the same advantages should be included in the scope of the present invention. For example, the impact tool with an appropriate combination of the biasing units described above will be effective to increase the impact force.

What is claimed is:

1. An impact tool comprising:

a motor;

an output shaft rotated by said motor;

a hammer for intermittently providing an impact force to said output shaft;

a hammer holder for movably holding said hammer;

an impact force generator for converting an output of said motor into a reciprocating motion of said hammer to generate the impact force; and an air chamber formed between said hammer and said hammer holder such that a volume of said air chamber is variable in response to a position of said hammer relative to said hammer holder;

wherein the impact tool further comprises a biasing unit configured to apply a bias force to said hammer in a direction toward said output shaft, thereby increasing the impact force in cooperation with an air pressure caused by a volume change of said air chamber, wherein said hammer holder is movably supported by a housing of the impact tool, and biased in the direction toward the output shaft against said housing by said biasing unit, so that said hammer indirectly receives the bias force for directing said hammer toward said output shaft through said hammer holder.

2. The impact tool as set forth in claim 1, wherein said bias unit comprises a fixed magnet on said hammer holder, a movable magnet supported in said housing of the impact tool and formed by a first region having one of N and S poles, and a second region having the other pole, and a drive unit configured to move the movable magnet such that when said hammer holder moves in the direction toward said output shaft, a magnetic repulsion force occurs between the fixed magnet and the first region of the movable magnet, and when said hammer holder moves in a direction away from said output shaft, a magnetic attraction force occurs between the fixed magnet and the second region of the movable magnet.

3. The impact tool as set forth in claim 1, further comprising a bias force adjusting unit configured to control a magnitude of the bias force provided by said biasing unit.

4. An impact tool comprising:

a motor;

an output shaft rotated by said motor;

a hammer for intermittently providing an impact force to said output shaft;

a hammer holder for movably holding said hammer;

an impact force generator for converting an output of said motor into a reciprocating motion of said hammer to generate the impact force; and an air chamber formed between said hammer and said hammer holder such that a volume of said air chamber is variable in response to a position of said hammer relative to said hammer holder;

wherein the impact tool further comprises a biasing unit configured to apply a bias force to said hammer in a direction toward said output shaft, thereby increasing the impact force in cooperation with an air pressure caused by a volume change of said air chamber, said impact tool further comprising a bias force adjusting unit configured to control a magnitude of the bias force provided by said biasing unit, wherein said biasing unit comprises first and second magnets, wherein said bias force adjusting unit is an adjust lever for controlling the distance between the first and second magnet and thereby adjusting the magnitude of the magnetic repulsion force generated therebetween, said adjust lever being coupled with one of the first and second magnets.

* * * * *